US010939716B1

(12) United States Patent
Toro

(10) Patent No.: US 10,939,716 B1
(45) Date of Patent: Mar. 9, 2021

(54) ADJUSTABLE HAT MEMBER

(71) Applicant: Daniel Toro, Brea, CA (US)

(72) Inventor: Daniel Toro, Brea, CA (US)

( * ) Notice: Subject to any disclaimer, the term of this patent is extended or adjusted under 35 U.S.C. 154(b) by 0 days.

(21) Appl. No.: 16/026,250

(22) Filed: Jul. 3, 2018

(51) Int. Cl.
*A42B 1/06* (2021.01)

(52) U.S. Cl.
CPC ..... *A42B 1/064* (2013.01); *A42B 1/063* (2013.01)

(58) Field of Classification Search
CPC ..... A42B 1/063; A42B 1/064; A42B 1/201; A42B 1/002; A42B 1/061; A42B 1/062; A42B 1/065; A42B 1/206; A42B 1/006; A42B 1/18; Y10T 16/547; Y10T 16/546
USPC ..... 2/195.1, 195.5, 195.6, 209.12, 209.11, 2/175.1, 175.4, 175.5, 195.2
See application file for complete search history.

(56) References Cited

U.S. PATENT DOCUMENTS 422,707 A * 3/1890 Bockel ..... E06B 3/485 160/229.1
2,642,018 A * 6/1953 Weeber ..... A01G 9/241 52/277
2,805,084 A * 9/1957 Hall ..... B42F 21/00 40/373
3,680,927 A * 8/1972 Neureuther ..... B65G 17/08 305/50
4,506,408 A * 3/1985 Brown ..... E05D 5/12 16/225
4,549,316 A * 10/1985 Johnson ..... A42B 1/201 2/195.1
4,776,454 A * 10/1988 Momose ..... B65G 17/08 198/850
4,839,924 A 6/1989 Laurence
5,175,913 A * 1/1993 Mackie ..... A63H 33/10 24/341
5,503,497 A * 4/1996 Dudley ..... A63H 33/042 403/103
5,669,071 A * 9/1997 Vu ..... A42B 1/247 2/10
5,802,616 A 8/1998 Watson
6,088,837 A * 7/2000 Baker ..... A61F 9/045 2/10
6,109,569 A * 8/2000 Sakaida ..... F16L 3/222 248/316.7
6,223,393 B1 * 5/2001 Knopf ..... G06F 1/1618 16/366
6,237,156 B1 * 5/2001 Ellman ..... A42B 1/064 2/10

(Continued)

FOREIGN PATENT DOCUMENTS

CA 2876832 A1 * 7/2015 ..... A42B 1/064

OTHER PUBLICATIONS

Results from STIC NPL Search. Performed May 13, 2020 by Mark Hutcherson and provided to Examiner. (Year: 2020).*

(Continued)

*Primary Examiner* — Jameson D Collier
(74) *Attorney, Agent, or Firm* — The Law Office Of Austin Bonderer, PC; Austin Bonderer

(57) ABSTRACT

An adjustable hat bill having a first link and a second link. The first link has a first link male member, and it defines a first link female receiving area. The second link defines a second link female receiving area. The first link male member is located within the second link female area, and the second link is capable of some rotation about the male member.

18 Claims, 5 Drawing Sheets

(56) References Cited

U.S. PATENT DOCUMENTS

| | | | | |
|---|---|---|---|---|
| 6,311,331 | B1 * | 11/2001 | Park | A42B 1/063 2/175.1 |
| 6,357,051 | B1 | 3/2002 | Lee | |
| 6,408,443 | B1 * | 6/2002 | Park | A42B 1/248 2/195.1 |
| 6,804,831 | B2 * | 10/2004 | Guerra | A42B 1/065 2/195.2 |
| D519,717 | S * | 5/2006 | Kim | D2/893 |
| 7,069,599 | B2 | 7/2006 | Guerra | |
| 7,152,251 | B2 * | 12/2006 | Yan | A42B 1/064 2/195.6 |
| 8,146,784 | B1 * | 4/2012 | Calanca | A47F 7/19 211/85.3 |
| 9,179,725 | B2 * | 11/2015 | Kim | A42B 1/062 |
| 2006/0143793 | A1 * | 7/2006 | Liao | A42B 1/063 2/195.6 |
| 2010/0331095 | A1 * | 12/2010 | Kwi Rim | A63B 69/3608 473/210 |
| 2012/0066814 | A1 | 3/2012 | Adams | |
| 2013/0312166 | A1 | 11/2013 | Hardy | |
| 2014/0304890 | A1 | 10/2014 | Carra | |
| 2018/0042323 | A1 | 2/2018 | Oh | |

OTHER PUBLICATIONS

Title: Horizon folding bill cap URL: https://www.thenorthface.com/shop/horizon-folding-bill-cap-3 Accessed: Mar. 8, 2018.

* cited by examiner

ADJUSTABLE HAT MEMBER

FIELD

The subject matter herein generally relates to hats having a bill or other projection from the head.

BACKGROUND

Most caps, including ball caps, have a bill that can be folded or left flat, however not both. Once a bill is folded, it is folded for good. One may be able to relax the fold, but it will never go back to fully flat. Additionally, a proper fold is hard to obtain. It takes some skill to fold a bill of a hat properly. If a bill is not folded properly the first time, it is understood, that the bill is never quite right.

BRIEF DESCRIPTION OF THE DRAWINGS

Implementations of the present technology will now be described, by way of example only, with reference to the attached figures, wherein.

DETAILED DESCRIPTION

Figure 1:
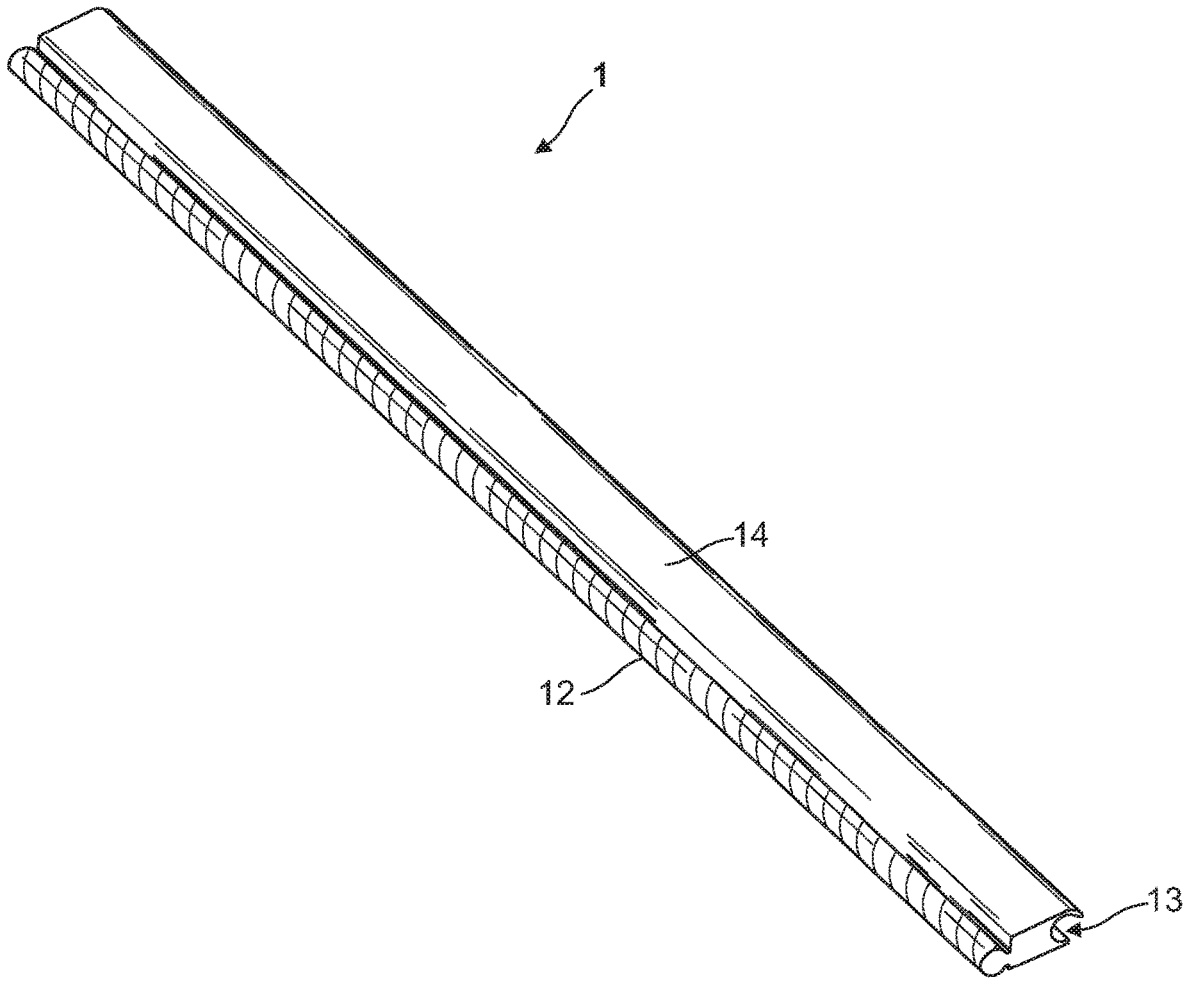
FIG. 1 is an embodiment of a link.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale, and the proportions of certain parts may be exaggerated to illustrate details and features better. The description is not to be considered as limiting the scope of the embodiments described herein. It should be noted that references to "an" or "one" embodiment in this disclosure are not necessarily to the same embodiment, and such references mean at least one.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" means "including, but not necessarily limited to"; it specifically indicates open-ended inclusion or membership in a so-described combination, group, series and the like.

The present disclosure is described in relation to what is traditionally known as a baseball cap or ball cap. While described in terms of a baseball cap, it is to be understood that any hat 2 can comprise of the bill 22 comprising links 1 or have links 1 attached thereto.

FIG. 1 illustrates an embodiment of a single link 1. The link comprises a substantially circular male member 12 and a body 14. The body 14 defines a female receiving area 13. In some embodiments, the male member 12 is sized so that it could be received within the female receiving area 13. In some embodiments, the male member the male member 12 the female receiving area 13 are smooth. The male member 12 is coupled to the body 14. In some embodiments, the male member 12 is coupled to the body 14 by a connector 121. The female receiving area 13 is at least partially defined by a top lip 131 and a bottom lip 132. In some embodiments, the top lip 131 defines a greater arc length than the bottom lip 132. In some embodiments, the top lip 131 and the bottom lip 132 define the same or substantially the same arc length. In some embodiments, the top lip 131 is less than that of the bottom lip 132.

Figure 2:
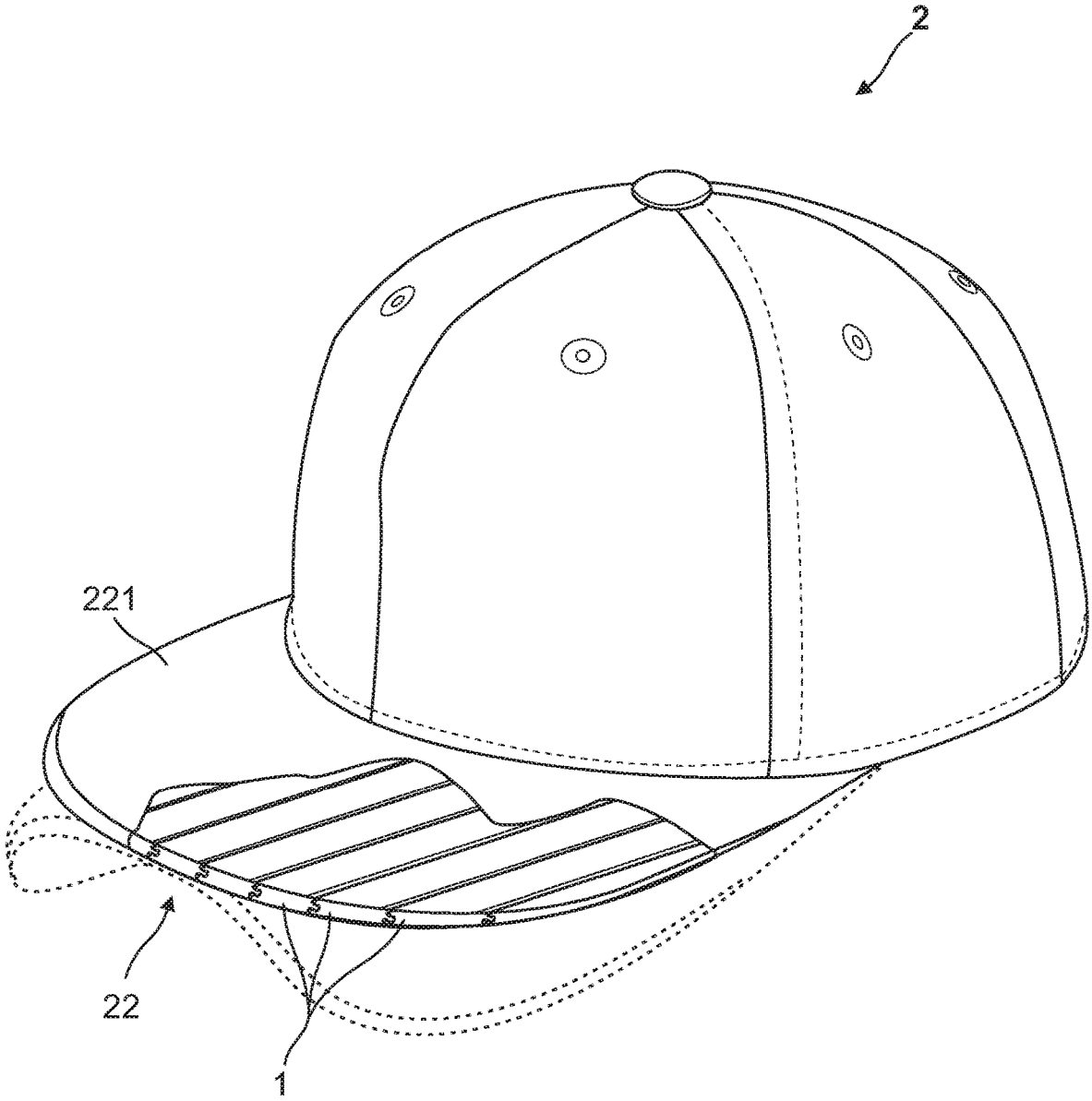
FIG. 2 is an embodiment of hat.

FIG. 2 illustrates an embodiment of a hat 2 comprising a bill 22 attached to a hat 2. The bill 22 comprises two or more links 1 that are coupled together. In some embodiments, the cross-sectional profile of the two or more links 1 are the same or substantially the same. In some embodiments, some, if not all of the cross-sectional profiles of the two or more links 1 are different (e.g., varying lengths, thicknesses and/or widths). In some embodiments, the links 1 on the edges of the bill 22 will have a taper and lack a male member 12 and/or a female receiving space 13. The bill 22 comprising the two or more links 1. The two or more links 1 allow for the adjustable shaping of the bill 22. As is known, once a bill 22 of a hat 2, for example, is folded, it is very difficult, if not impossible to get the bill 22 to return to its original flat shape or shape in which it is typically produced. The two or more links 1 allow the user to fold the bill 22 in many different configurations. In some embodiments, the top lip 131 and the bottom lip 132 will determine the range of motion. In some embodiments, the top lip 131 is shaped so that once adjacent links 1 form a plane, the top lip 131 prevents further rotation, such that when all of the links 1 in a bill 22 are shaped this way, the bill 22 will be considered a flat-bill 22. In some embodiments, the bottom lips 132 are shaped to provide pre-determined curvature of the bill 22. In some embodiments, the bottom lips 132, or vice versa the top lips 131, within a bill 22 have varying lengths to pre-define the curvature of a folded-bill 22. For example, individual sections, such as the ends of a bill 22, may not need to be rotated as much as those in other sections, such as the middle, to obtain the desired shape (e.g., a curved bill). In some embodiments, the bill 22 can have sections that move up past a planar configuration (see FIG. 8). In some embodiments, the bill 22 can be folded up as much as it can be folded down. In some embodiments, the interaction of the links 1 will have a firmer holding position, relative to other positions, at predetermined planar, as this will serve as an indication to the user that the bill 22 is flat. In some embodiments, there will be a firmer position at planar, lowermost rotation and/or uppermost rotation. The firmer position can be accomplished by the interaction between the female locking member 1301 and the male locking members 1201, and/or the top lip 131 and the bottom lip 132.

As seen in FIG. 2, in some embodiments all the links 1 have their male member 12 extending along the same direction along the entire width of the bill. In some embodiments, the bill comprises of the links 1 and bill material 221 that encloses the links. It is also seen how the bill 22 can move back and forth.

Figure 3:
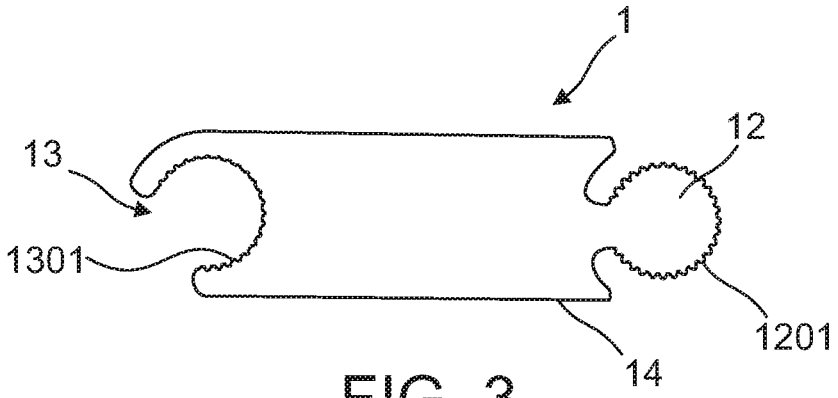
FIG. 3 is an embodiment of a link.

In FIG. 3, an embodiment of a link is shown.

Figure 4:
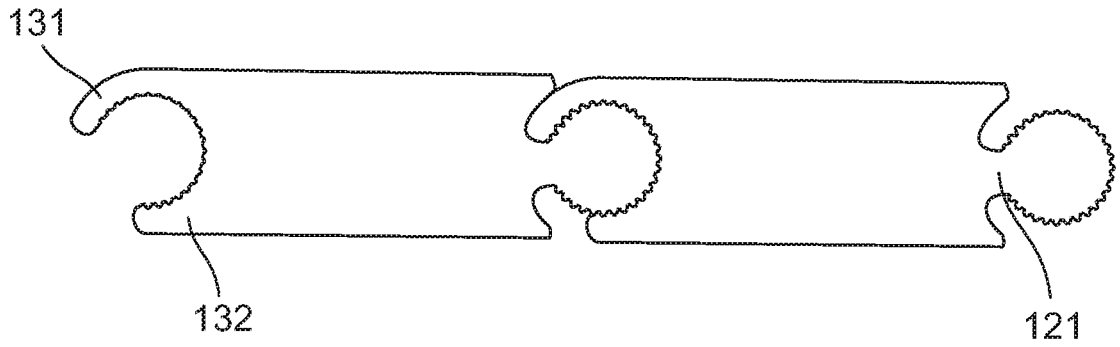
FIG. 4 is an embodiment of two links engaged with each other to form a plane.
Figure 5:
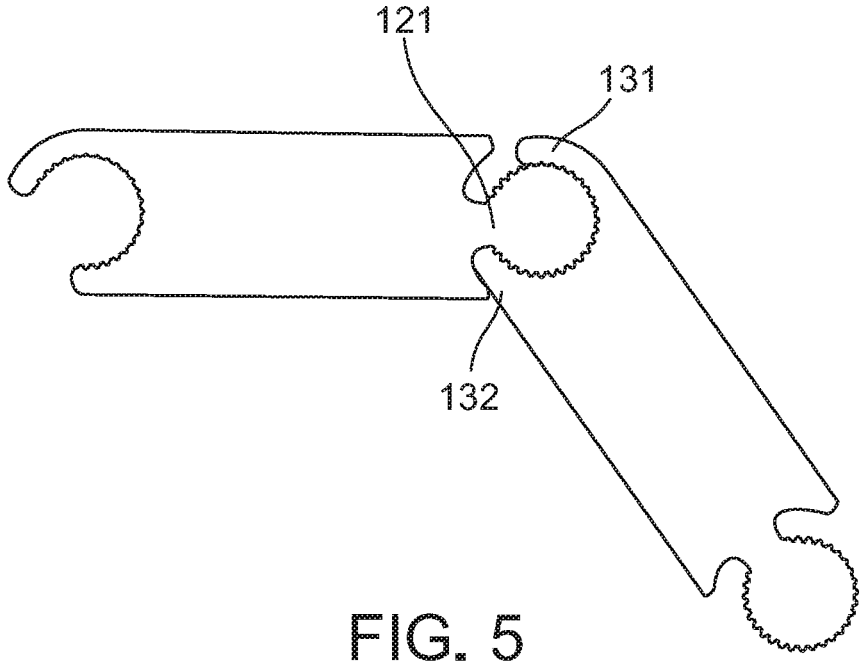
FIG. 5 is an embodiment of the two links engaged with each other to form an angle.

FIGS. 4 and 5 illustrates an embodiment of two links 1 in use. As can be seen in FIG. 4, the links 1 are in a planar position where the connector 121 abuts the top lip 131. In FIG. 5, the bill 22, by rotating the links 1 relative to each other, is manipulated into a curved position, and the connector 121 abuts the bottom lip 132.

Also shown in FIGS. 3-5, an embodiment of the links 1 having female locking members 1301 and male locking members 1201. The female locking members 1301 and the male locking members 1201 interact to provide selective rotation of the bill 22. The number of female locking member 1301 and male locking members 1201 can be predetermined. The less space between locking positions will provide for more specific positioning. More space between locking positions will provide for less specific positioning. In some embodiments the female locking members 1301 are grooves while the male locking members 1201 are projections that correspond with the female locking members 1301; in some embodiments, the arrangement is reversed. In some embodiments, similar to what is shown in FIGS. 3-5, both the female locking members 1301 and the male locking members 1201 comprise protrusions that define grooves and/or grooves that define protrusions. As mentioned above, in some embodiments, the interaction of the links 1 will have a firmer holding position, relative to other positions, at preset positions, as this will serve as an indication to the user that the bill 22 is in one or more of the predetermined positions. In some embodiments, there will be a firmer position at planar, lowermost rotation and/or uppermost rotation. The firmer position at preset positions can be accomplished by the interaction between the female locking members 1301 and the male locking members 1201. In some embodiments, the interaction between at least one male locking member 1201 and at least one female locking member 1301 interact specifically at a preset position (e.g., planar, obtuse angle, acute angle). In some embodiments, one or more female locking members and one or more male locking members are larger than the others, and these larger locking members will interact with each other at one or more preset positions. In some embodiments, only the preset positions will locking position between the female locking members 1301 and the male locking members 1201.

Figure 6:
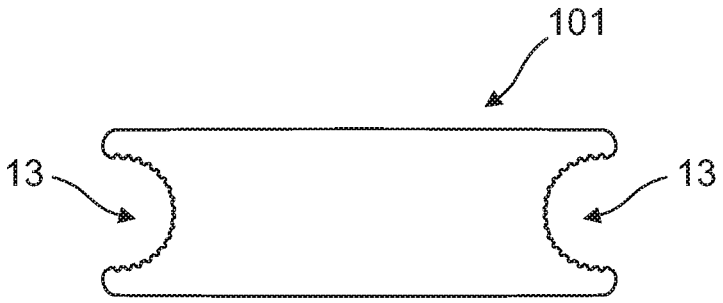
FIG. 6 is an embodiment of a link defining two female receiving areas.

FIG. 6 shows an embodiment of a link 1 comprising two female receiving areas 13 identified as a female unilink 101. The female unilink 101 defines a female receiving area 13 on both ends of the female unilink 101. In some embodiments, the bill 22 will have one or more female unilinks 101. In some embodiments, the bill 22 will have one female unilink 101 in the middle of the bill 22. In these embodiments, the bill 22 can have a more symmetric design about the middle of the bill 22 such that the links 1 that extend from each side of the female unilink 101 will be oriented the same.

Figure 7:
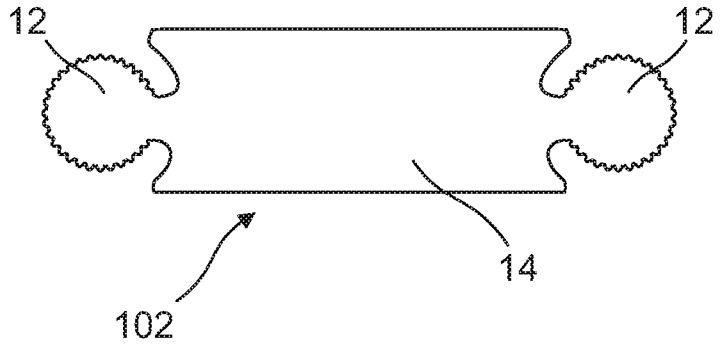
FIG. 7 is an embodiment of link comprising two male members.

FIG. 7 shows an embodiment of a link 1 comprising two male members 12 identified as a male unilink 102. The male unilink 102 comprises two male members 12. Much like the embodiments of the bill 22 employing the female unilink 101, some embodiments of the bill 22 employ one or more male unilinks 102. In some embodiments, the bill 22 will have one male unilink 102 in the middle of the bill 22 with links 1 extending therefrom. In these embodiments, the bill 22 will have a symmetric design about the middle of the bill 22 such that the links 1 that extend from each side of the male unilink 102 will be the same.

It is understood that in some embodiments, there may be one or more unilinks. These unilinks allow for the reversal of the direction extending direction of the male member 12 in a bill 22. In some embodiments, the center link 1 is a unilink and the remaining links 1 are symmetrical about the unilink, and this can allow for symmetrical folding of the bill 22.

Figure 8:
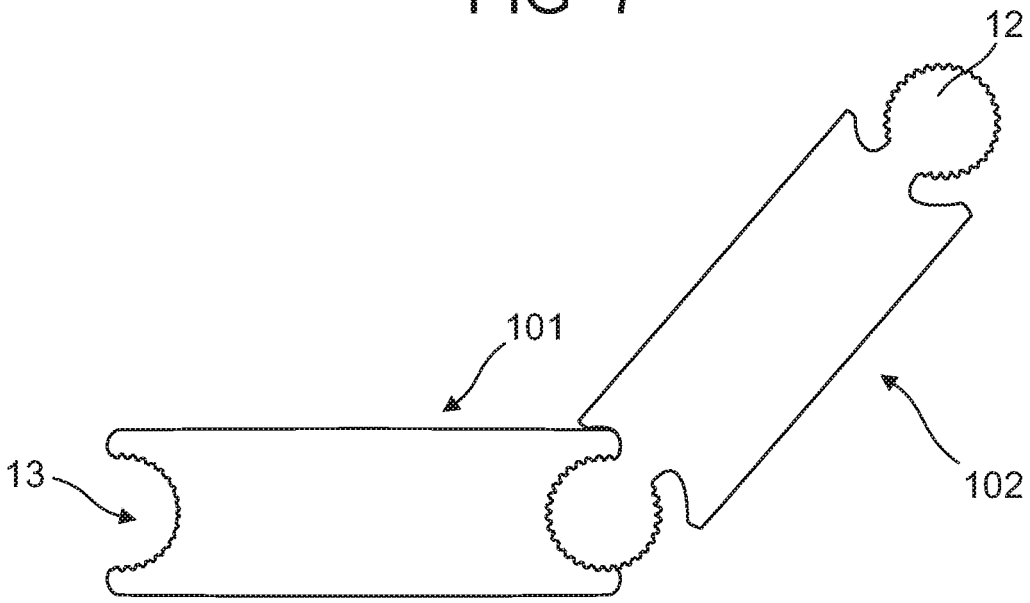
FIG. 8 is an embodiment of two links engaged with each other to from an angle.

FIG. 8 shows an embodiment of a male unilink 102 male member 12 received in a female unilink 101 female receiving area 13. In some embodiments, the bill 22 will comprise of one or more of both female unilinks 101 and male unilinks 102.

Figure 9:
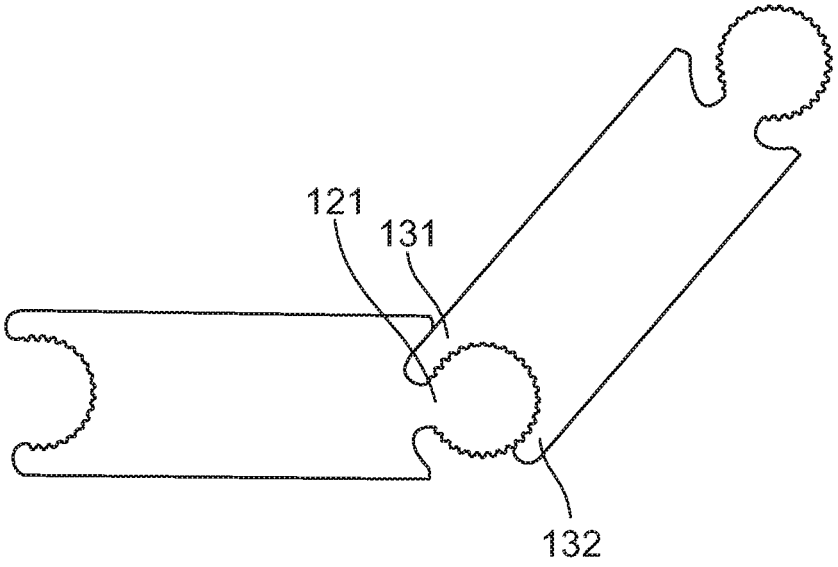
FIG. 9 is an embodiment of two links engaged with each other to form an angle.

FIG. 9 shows an embodiment of two links 1 in use. By rotating the links 1 relative to each other, the links 1 form an obtuse angle when one of the links 1 is in the uppermost position relative to the other link 1.

Also shown by FIG. 8 is the ability of the female unilinks 101 and the male unilinks 102 to vary the freedom of motion by adjusting the length of the top lip 131 and the bottom lip 132. While some embodiments will limit motion to a certain point (e.g., planar) other embodiments will allow for movement of some, if not all, of the links 1, including female unilinks 101 and male unilinks 102, past planar, either up and/or down. In some embodiments of the bill 22, the length of the top lips 131 and/or the bottom lips 132 need not be consistent among all of the links 1. In some such embodiments, some of the links 1 in the middle of the bill 22 may have a top lip 131 that limits the upper movement to planar while closer to the ends of the bill 22 the top lip 131 allows for greater upward movement. In some embodiments, the top lips 131 and bottom lips 132 of the links 1 may vary to provide for predetermined designs (e.g. "~" type shape) when at least some, if not all, of the links 1 abut a lip. In some embodiments, some adjacent links 1 will have upper lips and/or lower lips that vary incrementally in length. Again, as mentioned above, in some embodiments, the interaction of the links 1 will have a firmer holding position, relative to other positions, at predetermined positions (e.g., planar), as this will serve as an indication to the user that the links 1 are in a predetermined position. In some embodiments, there will be a firmer position at planar, lowermost rotation and/or uppermost rotation. The firmer position at preset positions can be accomplished by the interaction between the female locking members 1301 and the male locking members 1201 and/or the top lip and the bottom lip. Additionally, the predetermined positions can vary among the links 1, and can be determined by the link's 1 position in the bill 22.

In some embodiments, the link body 14 of the links 1 in a bill 22 will vary in width; while in other embodiments, they can be the same. In some embodiments, the center link 1 will have a link body 14 that is wider than the other links 1. In some embodiments, the link bodies 14 widths, thicknesses, and/or height, within the bill 22 will vary.

In some embodiments, the links 1 are covered by a bill material 221. In some embodiments, the links 1 are attached to an outside of a bill 22 to convert a traditional hat 2 into a hat 2 that can be taken from flat, to curved and back to flat. In these embodiments, the strength of the engagement between the links 1 would likely have to be greater to counteract the force of the traditional bill material 221. The links 1 can adhere to the underside or topside of a bill 22

It is to be understood that the lengths of the top lip 131 and the bottom lip 132 can vary as desired. In some embodiments, the combination of the top lip 131 and the bottom lip 132 will provide an interference fit to secure the male member 12 therebetween. In other embodiments, the bill material 221 can provide the force to maintain the engagement between adjacent links 1. In some embodiments, the top lip 131 and the bottom 132, in combination with the bill material 221 can provide the retaining force between adjacent links 1.

A method of making the bill 22 is also disclosed herein. In some embodiments of the method of making, a sheet of two or more connected links 1 is provided, and bill blanks in the shape of the bill 22 are stamped out. The blanks comprising of the links 1 are then covered with material and the bill 22 is attached to a hat 2. In some embodiments, the sheet of links 1 is formed contemporaneously with each other, pressed into an engagement, and then stamped.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

It should also be noted that elements of embodiments may be described in reference to the description of a particular embodiment; however, it is disclosed that elements of disclosed embodiments can be switched with corresponding elements of embodiments with the same name and/or number of other disclosed embodiments. It is also to be understood that terms indicating directionality such as top and bottom, are only used as a means to discuss the disclosure and do not require such a location (e.g., the item could be flipped, and the upper could actually be below the bottom as viewed by the natural horizon).

Depending on the embodiment, certain steps of methods described may be removed, others may be added, and the sequence of steps may be altered. It is also to be understood that the description and the claims drawn to a method may include some indication in reference to certain steps. However, the indication used is only to be viewed for identification purposes and not as a suggestion as to an order for the steps.

What is claimed is:

1. An apparatus comprising:

a hat comprising a bill, wherein the bill comprises:

a first link comprising a first link male member and defining a first link female receiving area; and a second link comprises a second link upper lip and a second link bottom lip; and a second link female receiving area is at least partially defined between the second link upper lip and the second link bottom lip;

wherein the first link male member is located inside the second link female receiving area and secured by the second link upper lip and the second link bottom lip; the first link male member defines a surface and comprises a male locking member located on the surface; wherein the male locking member interacts with the second link female receiving area to prevent free rotation of the first link and the second link in relation to each other; and the second link is capable of selective rotation about the first link male member.

2. The apparatus of claim 1, wherein the first link further comprises a first link body and a connector that couples the first link male member to the first link body; and the second link upper lip abuts the connector when the second link is selectively rotated to an uppermost position, and the second link bottom lip abuts the connector when the second link is selectively rotated to a lowermost position.

3. The apparatus of claim 2, wherein in the uppermost position, the first link and the second link define a plane.

4. The apparatus of claim 2, wherein in the uppermost position, the second link and the first link define an obtuse angle; and in the lowermost position, the second link and the first link define an obtuse angle or a plane.

5. The apparatus of claim 1, wherein the first link male member and the second link female receiving area have an interference fit.

6. The apparatus of claim 1, wherein the bill further comprises fabric that encloses the first link and the second link.

7. The apparatus of claim 1, further comprising a unilink, wherein the unilink either:

a) comprises two male members, or b) defines two female receiving areas.

8. An apparatus comprising:

a hat comprising a bill, wherein the bill comprises:

a first link and a second link having identical transverse cross-sections to one another, wherein each of the first link and the second link comprises:

a link body;

a male member; and a connector connecting the male member to the link body;

wherein the link body defines a female receiving area; the connector is thinner than the link body, and the connector is thinner than the male member;

wherein the male member of the first link is located inside the female receiving area of the second link.

9. The apparatus of claim 8, wherein each male member comprises at least one male locking member, each female receiving area comprises at least one female locking member; wherein the at least one male locking member and the at least one female locking member are configured to prevent free rotation of the male member of the first link in relation to the female receiving area of the second link.

10. The apparatus of claim 8, wherein each male member comprises at least one male locking member, each female receiving area defines at least one female locking groove; wherein the at least one male locking member and the at least one female locking groove are configured to prevent free rotation of the male member of the first link in relation to the female receiving area of the second link.

11. The apparatus of claim 8, wherein the male members and the female receiving areas are substantially smooth.

12. The apparatus of claim 8, wherein each female receiving area is at least partially defined by a top lip and a bottom lip; when the top lip of the second link abuts the connector of the first link, the second link is at an uppermost position;

and when the bottom lip of the second link abuts the connector of the first link, the second link is in a lowermost position.

13. The apparatus of claim 12, wherein in the uppermost position, the first link and the second link are substantially planar with one another.

14. The apparatus of claim 12, wherein in the uppermost position, the first link and the second link define an obtuse angle; and in the lowermost position, the first link and the second link define a plane or an obtuse angle.

15. The apparatus of claim 8, wherein the bill further comprises a unilink; and the unilink comprises: a unilink body; and either:

a) two unilink male members and two connectors connecting the two unilink male members to the unilink body respectively, or b) the unilink body defines two unilink female receiving areas.

16. The apparatus of claim 8, wherein at least one of the male members establishes an interference fit with a corresponding one of the female receiving areas.

17. The apparatus of claim 8, wherein the bill further comprises fabric; and the first link and the second link are enclosed within the fabric.

18. An apparatus comprising:

a hat comprising a bill, wherein the bill comprises:

a first link comprising a first link male member and defining a first link female receiving area; and a second link comprising a second link upper lip and a second link bottom lip; and a second link female receiving area is at least partially defined between the second link upper lip and the second link bottom lip;

wherein the first link male member is located inside the second link female receiving area and secured by the second link upper lip and the second link bottom lip; and the second link female receiving area either:

a) defines one or more female grooves that are capable of interacting with the first link male member to prevent free rotation, b) comprises one or more female locking members that are capable of interacting with the first link male member to prevent free rotation, or c) defines one or more female grooves and comprises one or more female locking members, wherein the one or more female grooves and the one or more female locking members are capable of interacting with the first link male member to prevent free rotation; and the second link is capable of selective rotation in relation to the first link male member.

* * * * *